US006105802A

United States Patent [19]

French et al.

[11] Patent Number: 6,105,802

[45] Date of Patent: Aug. 22, 2000

[54] PUSH-ON CLOSURE CONTAINER ASSEMBLY

[75] Inventors: Floyd R. French, Manchester; Michael P. Venegoni, St. Peters, both of Mo.

[73] Assignee: Clayton Corporation, Fenton, Mo.

[21] Appl. No.: 09/102,252

[22] Filed: Jun. 22, 1998

[51] Int. Cl.[7] ..... B65D 41/17

[52] U.S. Cl. ..... 215/318; 215/44; 215/329; 220/288

[58] Field of Search ..... 215/318, 329, 215/44; 220/288

[56] References Cited

U.S. PATENT DOCUMENTS

| | | | |
|---|---|---|---|
| 5,025,942 | 6/1991 | Lucas | 215/329 |
| 5,105,960 | 4/1992 | Crisci et al. | 215/329 |
| 5,307,946 | 5/1994 | Molinaro | 215/329 |
| 5,593,055 | 1/1997 | Repp et al. | 215/318 X |

FOREIGN PATENT DOCUMENTS

| | | | |
|---|---|---|---|
| 1399727 | 4/1965 | France | 215/329 |

*Primary Examiner*—Allan N. Shoap
*Assistant Examiner*—Joe Merek
*Attorney, Agent, or Firm*—Louis E. Marn

[57] ABSTRACT

There is disclosed a push-on closure-container assembly wherein a neck finish for a blow molded container of multiple external threads cooperates in a push-on operation with multiple internal threads of a closure wherein the number of leads of like pitch of the multiple-external threads of the neck finish in less than the number of leads of like pitch of the multiple internal threads of the closure and wherein the threads of the neck finish of the container are thicker than the threads of the closure.

6 Claims, 1 Drawing Sheet

PUSH-ON CLOSURE CONTAINER ASSEMBLY

BACKGROUND OF THE INVENTION

1. Field of the Invention

This invention relates to a push on closure for a container and more particularly to a neck configuration for a container formed by blow molding technique for cooperating with a multiple-threaded closure by longitudinal movement of the closure with respect to the axis of the neck of the container.

2. Description of the Prior Art

Both plastic and metal closures for various bottles and containers which include a tamper-evident feature have been known for many years. In most cases, this tamper-evident feature comprises a lower shoulder or skirt portion of the closure which is in some way intended to fracture or break upon removal of the closure from the container, so that it then becomes evident that the container has been opened. While a large number of these closures have been known in the past, on a commercial basis, and particularly in connection with soda bottles and other such containers maintained under significant pressures, up until quite recently metal closures have predominated. These include closures such as shown in U.S. Pat. No. 3,812,991 which issued on May 28, 1974 to the Coca Cola Company, and many others.

In U.S. Pat. No. 4,625,875 to Carr, et al. there is disclosed a tamper-evident closure including a depending tamper-evident skirt member capable of being positioned by longitudinal force (i.e. pushed on) onto a neck of a container including a skirt collar wherein the closure is formed with an internal thread and the neck of the container is formed with a corresponding external thread and wherein the tamper-evident depends by angularly-formed arm members from the closure, and wherein the threads are of like multiple courses and wherein a groove of the skirt member of the closure engages the skirt collar of the container in an assembled relationship of the closure to the container.

The materials of the construction for the closure and container are of like flexible thermoplastic composition, e.g. polyethylene for the packaging of milk and like products. Extrusion blow molding of containers from a continuous tube of polyethylene is generally the process of choice.

There is the desire to use blow molding techniques, and other thermoplastic materials in forming containers, such as polyethylene terephthalate (PET), starting with the formation of a preform from which the container is subsequently formed in blow molds using the neck of the container as the transporting medium. While a neck finish of a predetermined diameter of a HDPE bottle may cooperate with a closure having a cooperating threaded configuration, however, a neck finish of a blow molded PET container would be thick, requiring excessive cycling times and potentially resulting in molding imperfections which would impair or inhibit cooperation with a push-on, multiple-threaded closure.

OBJECTS OF THE INVENTION

It is an object of the present invention to provide a neck finish for a container formed by blow molding techniques to cooperate with a multiple threaded closure of a flexible plastic material in a push-on relationship.

Yet another object of the present invention is to provide a multiple threaded neck finish for a container formed by blow molding techniques to cooperate with a multiple threaded closure of a flexible plastic material in a push-on relationship requiring nominal, of any, subsequent twisting of the closure on the container to effect fluid tight setting.

A further object of the present invention to provide a multiple threaded neck finish for a container formed by blow molding techniques to cooperate with a multiple threaded closure of a flexible plastic material in a push-on relationship requiring nominal, if any, subsequent twisting of the closure on the container, wherein the closure is provided with a tamper-evident skirt readily separated from the closure by twisting the closure in an opening operation with respect to the container.

SUMMARY OF THE INVENTION

These and other objects of the present invention are achieved in a push-on closure-container assembly wherein a neck finish for a blow molded container of multiple external threads cooperates in a push-on operation with multiple internal threads of a closure, wherein the number of threads of like lead of the multiple-external threads of the neck finish is less than the number of threads of like lead of the multiple internal threads of the closure and wherein the threads of the neck finish of the container are thicker than the threads of the closure.

BRIEF DESCRIPTION OF THE DRAWINGS

A better understanding of the present invention as well as other objects and advantages thereof will become apparent upon consideration of the detailed disclosure thereof, especially when taken with the accompanying drawings wherein.

DETAILED DESCRIPTION OF THE DRAWINGS

Figure 1:
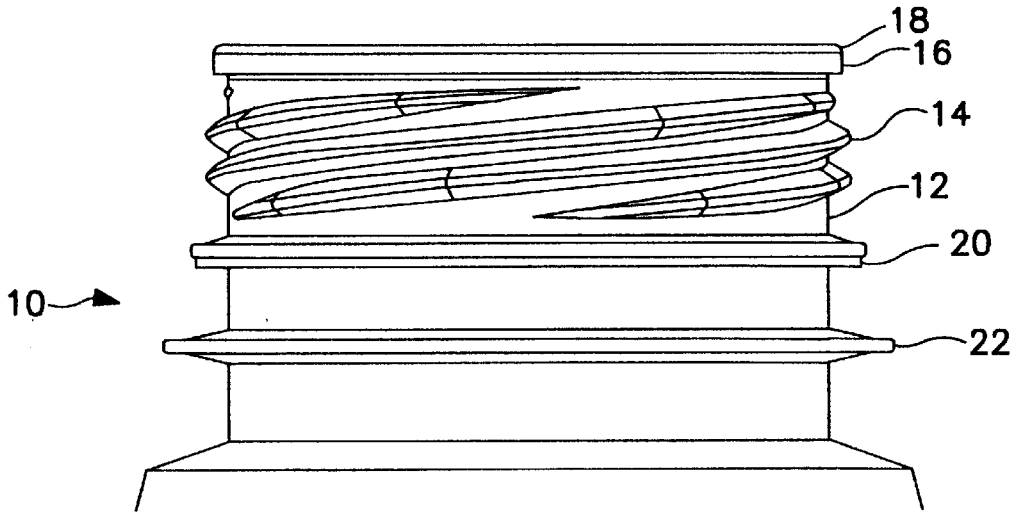
FIG. 1 is an elevational view of a neck finish of a container of the present invention.
Figure 2:
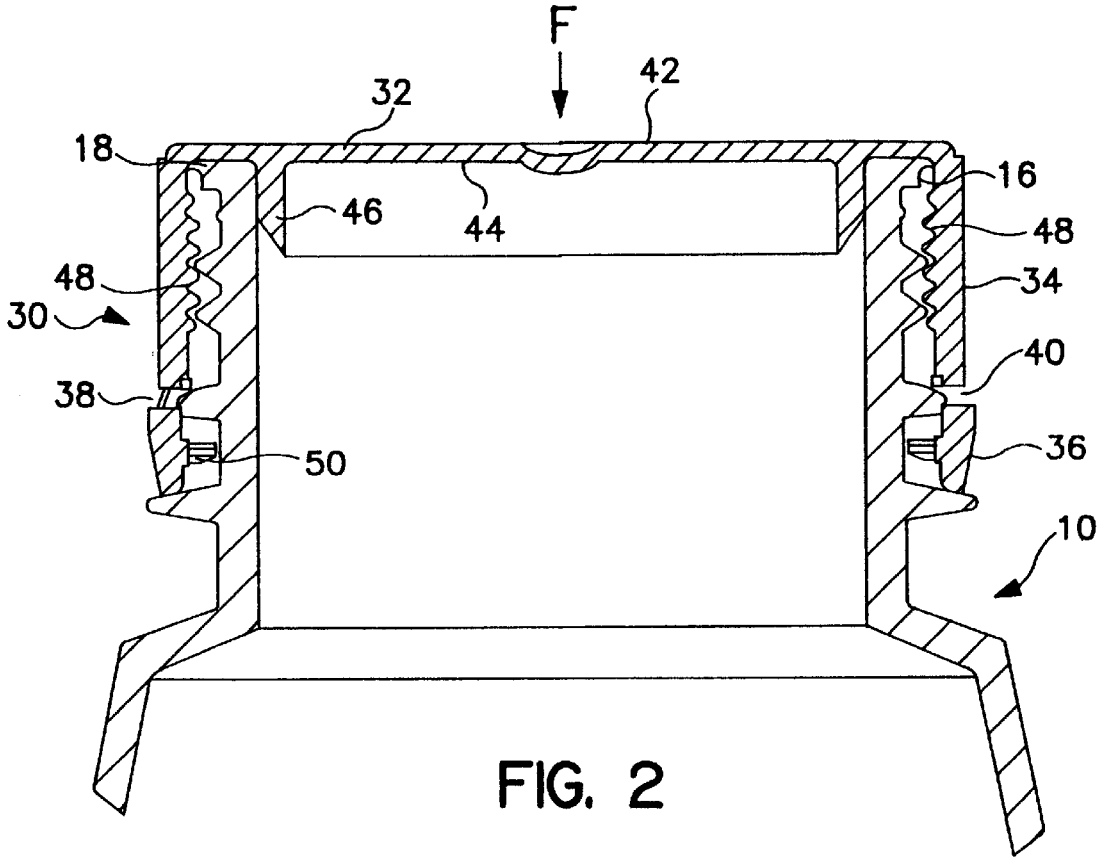
FIG. 2 is a partial cross-sectional view of the embodiment of FIG. 1 having a multiple threaded closure mounted thereon.

Referring now to FIGS. 1 and 2, there is illustrated a container, generally indicated as 10 formed with a neck 12 having multiple external threads 14, as more fully hereinafter described. The neck 12 is formed with an upper outwardly extending ring member 16 having a locking lip 18, an intermediate outwardly extending ridge or skirt portion 20 and a lower outward extending collar portion 22 formed on an external surface thereof.

A closure, generally indicated as 30, referring now to FIG. 2 is provided for the container 10 and is of like structure to the structure of the closure described in U.S. Pat. No. 4,625,875 to Carr, et al., herein incorporated by reference.

The closure 30 is comprised of an upper end wall 32, a cylindrically-shaped side wall 34 and a ring-shaped tamper-evident skirt member 36 depending from the cylindrically-shaped side wall 34 by a plurality of arm members 38 (one shown) angularly-disposed with reference to a center axis of the closure 30 thereby forming a ring-shaped opening 40 between the cylindrically-shaped side wall 34. The closure member 30 is formed of a suitable thermoplastic material, such as low density polyethylene or like thermoplastic materials possessing certain characteristics of flexibility, as will hereinafter become more apparent. The arm members 38 are configured and angularly-disposed to provide a spring-like action between the skirt member 36 with the upper side wall 34 of the closure 30.

The end wall 32 of the closure 30 includes an outer surface portion 42 and an inner surface portion 44 including a cylindrically-shaped internal centering element 46 depending inwardly essentially coincident to the cylindrically-shaped side wall 34 to facilitate centering and act together with the lip 18 of the container as a seal valve for the container 10.

The cylindrically-shaped side wall 34 of the closure 30, is formed with internal threads 48. The internal threads 48 of the closure 30 and the external threads 14 of the container 10 are of the multiple thread type whereby the closure 30 assumes a level position of substantially coaxial alignment with the axis of the container 10 when positioned on the neck 12 of the container 10. After such positioning, a longitudinal force (as indicated by the arrow F) referring to FIG. 2 is applied to the closure 30 to force the closure 30 onto the neck 12 of the container 10, i.e. the closure 30 is pushed onto the neck 12 of the container 10 to a point where an internal flange 50 formed in the skirt member 36 cooperates with the ridge or collar 20 formed on the neck 12 of the container 10.

During downward movement of the closure 30, wall sections (not shown) contact an upper surface portion of the skirt member 36 to assist in positioning of the skirt member 36 about the ridge or collar 20 in a tamper-evident mode, i.e. the closure 30 may not now be removed from the container 10 without fracturing the arm members 38 and thereby retains the tamper-evident skirt member 36 about the neck portion 12 of the container 10. It is apparent to one skilled in the art that subsequent positioning, i.e. by pushing the closure 30 onto the neck 12 of the container 10 may not result in the complete cooperation in fluid tight interrelationship of the closure 30 with the container 10, and thus as a step in the bottling protocol requires a slight twisting of the closure 30 with respect to the container.

To cooperate in a push-on relationship with a closure 30 having multiple internal threads, threads of the external threads of the neck 12 of the container 10 are of like lead and of lesser number than the number of threads of like lead of the internal threads of the closure, e.g. 8 internal threads to 4 or less with the depth of the external threads of the neck being greater than the depth of the internal threads of the closure 30. The term "of like lead" is defined by the fact that the threads of the container 10 and closure 30 are in paralleled relationship. With reduction in the wall thickness of the neck of the container 10, the number of leads of the external threads are reduced with concomitant increase in thickness of the threads thereof to provide varying ratios of threads of like lead of the container 10 to threads of like lead of the closure 30, e.g. 5:10; 3:9; 4:8; 2:8; 3:6; 2:4, etc. Thus there is a plethora of combinations of thread ratios of given T1 threads of the closure to T2 threads of the container where T2 would equal T1/N (where N is 2, 3, 4, . . . , T1) provided the quantity T1/N is a whole number with the thickness of the external threads of the container being increased with decreasing number of leads thereof.

While the invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalent thereof.

What is claimed:

1. A push-on closure and container assembly, which comprises:

a one-piece closure body, including an upper closure portion comprised of an end wall and a cylindrical side wall, said cylindrical side wall having an internal multiple threaded configuration; and a container having threaded neck portion of a cooperating multiple threaded configuration to thereby permit positioning of said closure on said threaded neck portion of said container by a downward force on said closure, number of threads of said multiple threaded configuration of said container being of lesser number than a number of threads of said multiple threaded configuration of said closure.

2. The push-on closure container assembly as defined in claim 1 wherein thickness of said threads of said container is greater than thickness of said threads of said closure.

3. The push-on closure container assembly as defined in claim 1 wherein said internal threads of said closure are of identical lead but not identical pitch to said external threads of said container.

4. The push-on closure container assembly as defined in claim 1 wherein said closure includes a skirt for cooperating with a flange on said neck of said container in a tamper evident relationship.

5. The push-on closure container assembly as defined in claim 1 wherein said closure includes a skirt for cooperating with a flange on said container said container formed by blow molding techniques.

6. The push-on closure container assembly as defined in claim 5 wherein said ratio of threads of said closure (T1) to threads of said container (T2) is selected from the group consisting of T1:T2 where T2=T1/N (given N is 2, 3, 4, . . . , T1) provided the quantity T1/N is a whole number.

* * * * *